United States Patent [19]

Schneider, Jr. et al.

[11] 4,005,659

[45] Feb. 1, 1977

[54] IMPACT ACTUATED PROJECTILE FUZE

[75] Inventors: Clayton J. Schneider, Jr., East Aurora; Harold A. Washburn, Williamsville; John E. Blickenstaff, North Tonawanda, all of N.Y.

[73] Assignee: Calspan Corporation, Buffalo, N.Y.

[22] Filed: Aug. 20, 1975

[21] Appl. No.: 606,136

[52] U.S. Cl. ..... 102/72; 102/75; 102/85

[51] Int. Cl.[2] ..... F42C 1/12

[58] Field of Search ..... 102/73 R, 72, 70 R, 102/75, 76 R, 85

[56] References Cited

UNITED STATES PATENTS

| | | | |
|---|---|---|---|
| 1,369,476 | 2/1921 | Semple | 102/75 |
| 1,537,208 | 5/1925 | Wiley | 102/73 R |
| 2,270,342 | 1/1942 | Remondy | 102/73 R |
| 3,625,152 | 12/1971 | Schneider et al. | 102/85 X |

*Primary Examiner*—David H. Brown
*Attorney, Agent, or Firm*—Allen J. Jaffe

[57] ABSTRACT

A projectile housing. A body of pyrotechnic material in the housing. A delay casing containing fusing material fixed to the housing fabricated of a material that looses its structural integrity in response to the heat of a fuze flame front, whereby upon impact of the projectile the casing separates permitting the burning fuze material to come in contact with and ignite the pyrotechnic. There is further provided means to release the casing from the housing upon premature or short range impact prior to the ignition of the fusing material contained therein.

16 Claims, 2 Drawing Figures

IMPACT ACTUATED PROJECTILE FUZE

BACKGROUND OF THE INVENTION

The present invention relates to fuzes and, more particularly, to those which are armed upon firing and actuated upon impact.

Fuzes have been employed which prevent immediate actuation of the main charge by the provision of a fixed delay period or by the provision for impact actuation or both. Prior U.S. Pat. No. 3,625,152 is of the impact actuation type and incorporates a pyrotechnic delay material packed in a tube or container rigidly fixed to the base end of the projectile. Upon suitable ignition of the delay material, the mechanical properties of the tube are effectively destroyed in response to the heat thereof, permitting the burning pyrotechnic to travel in a direction making contact with the main charge upon impact. Whereas the above-mentioned patent overcomes the difficulties experienced with impact fuzes incorporating mechanical latching or detaining mechanisms, there is no mechanism to prevent ignition of the main charge upon premature or short range impact.

SUMMARY OF THE INVENTION

It is, accordingly, an object of the present invention to provide an impact actuated fuze incorporating means which function to interrupt the normal sequence of events leading to ignition of the main charge in the event of premature or short range impact and, as such, the present invention is an improvement over U.S. Pat. No. 3,625,152.

Basically the present invention provides a fuze tube or delay casing releasably secured to a projectile housing by means which function to separate the tube therefrom upon premature impact, such means may typically comprise an adhesive material whereby upon premature impact fusing material in the delay casing is prevented from being ignited. In this manner the main charge in the projectile is not ignited in the manner disclosed and described in the above-mentioned U.S. Pat. No. 3.625,152; whereas if impact occurs subsequent to the ignition of the fuzing material in the delay casing, then the main charge in the projectile is ignited in the manner of U.S. Pat. No. 3,625,152.

BRIEF DESCRIPTION OF THE DRAWINGS

For a fuller understanding of the present invention reference should now be had to the following detailed description thereof taken in conjunction with the accompanying drawings wherein.

DESCRIPTION OF THE PREFERRED EMBODIMENT

Figure 1:
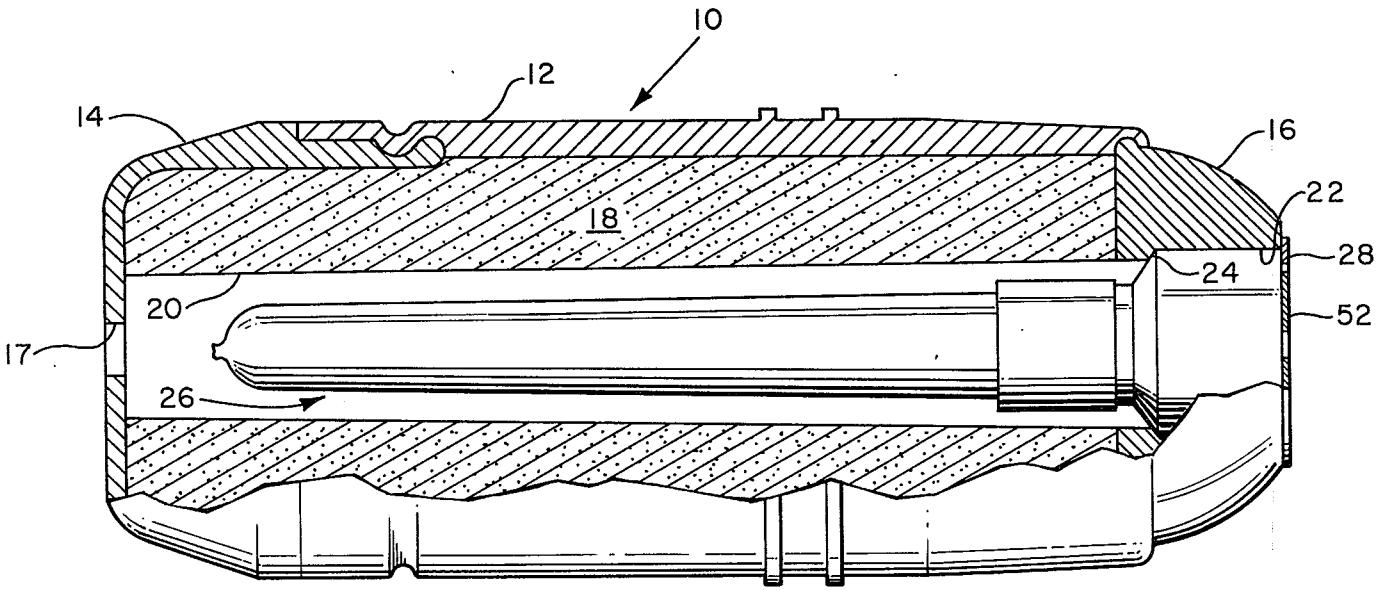
FIG. 1 is a cross-sectional view of a projectile illustrating the impact actuated fuze in position therein.

Referring now to the drawings and, more particularly, to FIG. 1, a projectile housing is generally depicted at 10 and is defined by a generally cylindrical central section 12 to which is suitably affixed a cup-shaped forward end or ogive 14 and a base end plug 16. Forward end 14 has a conventional vent opening 17 therethrough. The housing may be fabricated of any suitable material such as an aluminum alloy or steel. A main charge 18 substantially fills the interior of projectile housing 10 except for a central bore 20 extending between the ends thereof. Base end plug 16 has a central opening 22, concentric with bore 20, terminating in a reduced stepped opening or an annular ledge 24.

The impact actuated fuze according to the present invention is generally depicted at 26 and is received in bore 20, supported by ledge 24 and secured to end plug 16 by a suitable retainer 28 such as an aluminum tape disc.

Figure 2:
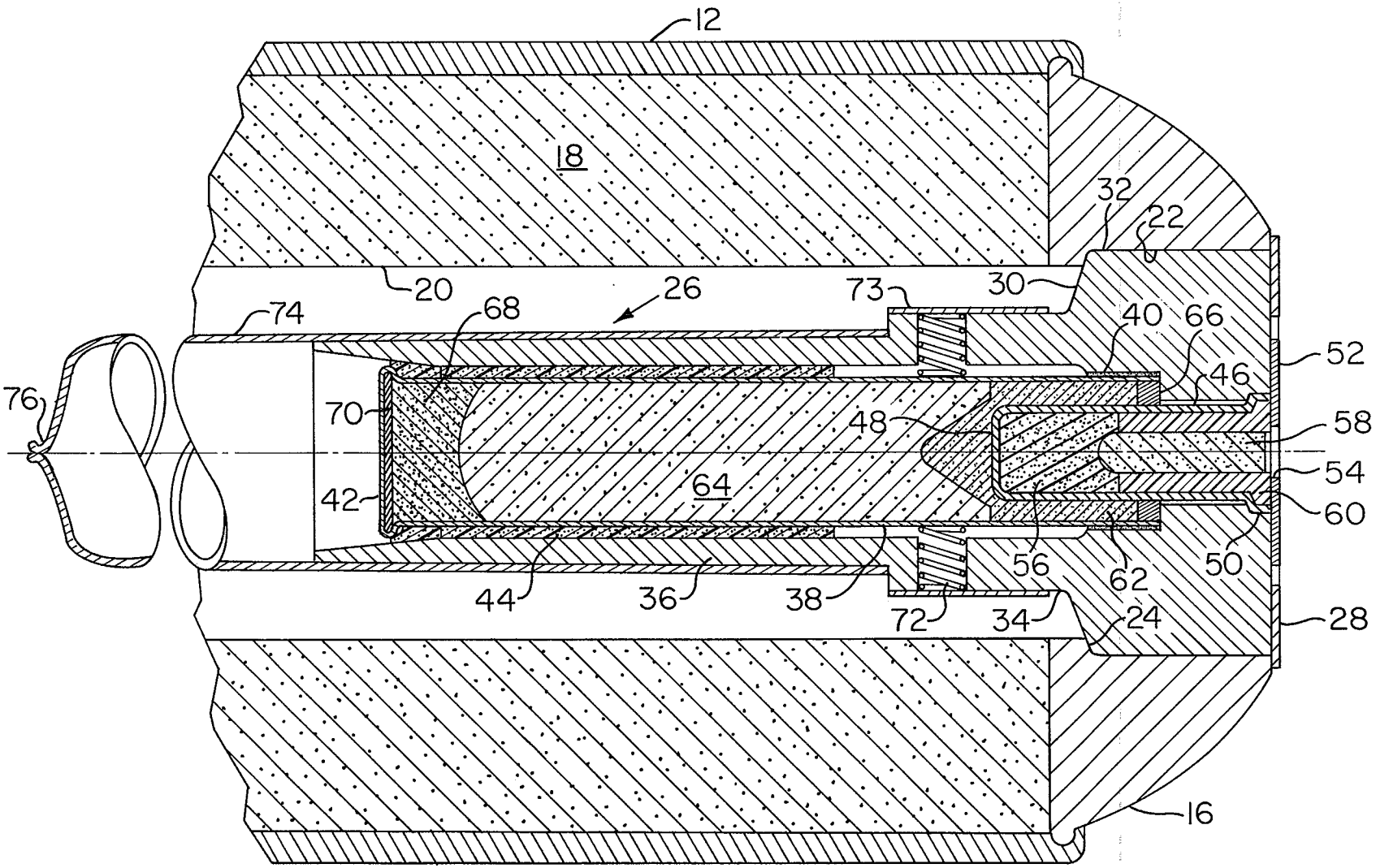
FIG. 2 is an enlarged fragmentary cross-sectional view of the details of the impact actuated fuze according to the present invention.

As illustrated in FIG. 2, the fuze comprises a housing 30 having three generally cylindrical sections 32, 34 and 36 decreasing in diameters towards the forward end 14 of the projectile. Section 32 is received in opening 22 and contacts ledge 24, whereas sections 34 and 36 are received in bore 20 and are spaced from the cylindrical wall thereof. Housing 30 has a hollow interior for the reception of the fuzing materials and structure, to be described hereinbelow.

A substantially tubular delay tube casing 38 is releasably secured to the interior of section 32 by means of a suitable adhesive 40 such as epoxy polamide or polysulfides, the bond strength of which is chosen not to withstand the forces resulting from premature impact as will become apparent hereinbelow. Delay tube is preferably constructed of a material that looses its structural integrity in response to the heat of a flame front as disclosed in U.S. Pat. No. 3,625,152. Such material may comprise, for example, soft aluminum such as 3003-0. Tube 38 is closed at its forward end 42 and is spaced from the interior walls of sections 34 and 36. A suitable sleeve 44, such as polyurethane foam, surrounds tube 38 in contacting relation therewith and with the interior of section 36.

Projecting through the interior of section 32 and extending into the interior of section 34 is heat transfer means in the form of a tubular member 46 having a closed forward end 48 and an open rear end 50 suitably secured to the rear end of section 32 by suitable means such as adhesive tape disc 52 or the like having a central opening 54 passing therethrough. The exterior periphery of member 46 may also be secured to the interior walls of section 32 by a suitable adhesive. Tubular member 46 is fabricated of a suitable material, having a fairly high coefficient of heat transfer, such as steel. The forward portion of member 46 is packed with a suitable heat mix 56 which might typically comprise a mixture of 60% barium chromate and 40% zirconium, by way of illustration and not limitation. A first fire mix 58 passes through a central opening in a sleeve 60 and projects into contacting relationship with heat mix 56. First fire mix 58 is fabricated of a suitable pressed priming material such as red lead and silicon. Contained within delay tube casing 38 and in surrounding, sliding and contacting relationship to member 46 is a transfer mix 62 which might typically comprise a mixture of 83% barium chromate and 17% boron. Mix 62 has a tapered forward end projecting into a delay mix 64, whereas the opposite end of mix 62 is closed by a washer 66 suitably secured thereto and to delay casing 38. Washer 66 surrounds member 46 and is in sliding contact therewith. Delay mix 64 comprises a body of fusing material such as a slag producing pyrotechnic. One specific example of such material would be a 3% boron and a 97% barium chromate mixture. An output mix 68 contacts the forward end of delay mix 64 and is located adjacent end 42 of tube 38 separated therefrom by a foil disc 70. Mix 68 might typically comprise a compressed priming material such as red lead and silicon.

It can thus been seen that member 46 divides delay tube 38 into two sections, one of which is releasably secured to the fuze housing 30 and consists of the materials contained within tube 38 and exterior of member 46; whereas the other of which is fixedly secured to fuze housing 30 and consists of the materials contained within member 46.

A plurality of compression springs 72 pass through openings in section 34 of casing 30 and abutt against the outer periphery of delay tube 38. The axis of the springs are substantially perpendicular to the longitudinal axis of the delay tube. Springs 72 are held in place by any suitable retaining means such as aluminum foil tape 73.

An elongated dust tube 74 having a closed forward end 76 is mounted on the periphery of section 36 of casing 30 and extends therebeyond into the bore 20 of projectile 10, as seen more clearly in FIG. 1.

The operation of the present invention will now be described.

When the projectile is fired by conventional means (not illustrated) the first fire mix 58 receives ignition (from propellant in a cartridge case, for example) and burns through to ignite heat mix 56 which, in turn, causes member 46 to become "red hot" whereby the transfer mix 62 is ignited. The transfer mix ignites the delay mix 64 producing a flame front which travels therethrough producing enough heat to melt, pyrolize or otherwise weaken the structural integrity of the aluminum delay casing 38 just behind the flame front. Upon impact the delay casing 38 parts at the weakened zone, allowing the burning portion of the delay mix 64 to plunge forward through dust tube 74 into the main charge 18 of the projectile and thereby igniting the same.

If impact does not occur in a specified time, say six seconds, the delay mix 64 continues to burn until it ignites the output mix 68 which sprays flame and slag into the main charge 18 to ignite the same.

In the event of premature or short range impact occurring prior to ignition of transfer mix 62, sufficient forces are applied to the adhesive bond 40 causing a failure thereat. This failure permits the entire delay casing 38 and the contents thereof to move forward out of contact with member 46 to thereby prevent ignition of transfer mix 62; the projectile main charge fails to ignite, resulting in an intentional dud. The springs 72 function to prevent rebound of the delay casing back into contact with the hot member 46. Moreover, in the event of some rebound, the washer 66 functions to separate the transfer mix 62 from the hot end 48 of member 46.

The dust tube 74 and sleeve 44 function to prevent flamible dust from the main charge from reaching the hot member 46 and transferring ignition thereto.

Although a preferred embodiment of the present invention has been disclosed and described, changes will obviously occur to those skilled in the art. For example other well known materials, as well as proportions, could be substituted for the exemplary pyrotechnic mixes given. Moreover, upon premature or short range impact it is possible that the strength of delay casing 38 be chosen to be less than that of adhesive 40 whereby separation of the casing causes a gap between transfer mix 62 and hot member 46 to prevent ignition transfer from one to the other. It is therefore intended that the present invention is to be limited only by the scope of the appended claims.

We claim:

1. A projectile comprising;
a. a projectile housing,
b. a main charge of ignitable material in said housing,
c. a delay casing releasably fixed to said housing containing an ignitable fusing material,
d. heat transfer means fixed to said housing for transferring heat to said ignitable fusing material, and
e. means for releasing at least a portion of said delay casing from said housing and separating said ignitable fusing material from said transfer means upon impact of said housing prior to the ignition of said fusing material, whereby said main charge is prevented from being prematurely ignited.

2. The projectile according to claim 1, wherein;
said delay casing is fabricated of a material which is sufficiently weakened by the heat generated upon ignition of said fusing material such that upon impact of said housing a portion thereof separates from the remainder thereof whereupon the separated portion and the fusing material come into contact with said main charge to thereby ignite the same.

3. The projectile according to claim 1, wherein;
f. said delay casing is releasably secured to a fuze housing which is secured to said projectile housing, and
g. said transfer means is fixed to said fuze housing.

4. The projectile according to claim 1, wherein;
said main charge substantially fills said housing and has a throughbore extending therethrough and wherein,
g. said delay casing is substantially tubular and located within said throughbore.

5. The projectile according to claim 4, wherein;
h. said transfer means comprises a substantially tubular member having a closed end projecting into said delay casing and normally contacting said ignitable fusing material.

6. The projectile according to claim 1, wherein there is further provided;
f. means for preventing said fusing material from rebounding into contact with said transfer means after release of at least said portion of said delay casing.

7. The projectile according to claim 11, wherein;
g. said last mentioned means includes a plurality of springs normally in contact with said delay casing, each having an axis substantially perpendicular to the longitudinal axis thereof.

8. The projectile according to claim 1, wherein;
f. said means for releasing comprises an adhesive the bond strength of which is insufficient to withstand the forces generated upon premature impact of said projectile.

9. The projectile according to claim 8, wherein;
g. said delay casing is fabricated of a material which is sufficiently weakened by the heat generated upon ignition of said fusing material such that upon impact of said housing a portion thereof separates from the remainder thereof whereupon the separated portion and the fusing material come into contact with said main charge to thereby ignite the same.

10. The projectile according to claim 9, wherein;

h. said main charge substantially fills said housing and has a throughbore extending therethrough and wherein, i. said delay casing is substantially tubular and located within said throughbore.

11. The projectile according to claim 10 wherein;

j. said delay casing is releasably secured to a fuze housing which is secured to said projectile housing, and k. said transfer means is fixed to said fuze housing.

12. The projectile according to claim 11, wherein;

l. said transfer means comprises a substantially tubular member having a closed end projecting into said delay casing and normally contacting said ignitable fusing material.

13. A projectile fuze, comprising;

a. a fuze housing, b. a delay casing releasably fixed to said housing, a body of ignitable fusing material located in said casing, d. heat transfer means secured to said housing for transferring heat to said fusing material, and e. means for releasing at least a portion of said delay casing from said housing and separating said fusing material from said transfer means upon impact prior to ignition of said fusing material.

14. The fuze according to claim 13, wherein;

f. said delay casing is fabricated of a material which is sufficiently weakened by the heat generated upon ignition of said fusing material such that upon impact a portion thereof separates from the remainder thereof.

15. The fuze according to claim 13, wherein;

f. said means for releasing comprises an adhesive the bond strength of which is insufficient to withstand the forces generated upon impact prior to ignition of said fusing material.

16. The fuze according to claim 15, wherein;

g. said delay casing is fabricated of a material which is sufficiently weakened by the heat generated upon ignition of said fusing material such that upon impact a portion thereof separates from the remainder thereof.

* * * * *